United States Patent [19]

Young et al.

[11] Patent Number: 4,628,995

[45] Date of Patent: Dec. 16, 1986

[54] GAUGE CARRIER

[75] Inventors: David E. Young, Seabrook, Tex.; Danny S. Sebastian, Denver, Colo.

[73] Assignee: Panex Corporation, Sugar Land, Tex.

[21] Appl. No.: 764,560

[22] Filed: Aug. 12, 1985

[51] Int. Cl.[4] ..... E21B 47/06

[52] U.S. Cl. ..... 166/113; 166/242

[58] Field of Search ..... 166/242, 243, 113, 183, 166/324; 175/40, 48, 320

[56] References Cited

U.S. PATENT DOCUMENTS

| | | | |
|---|---|---|---|
| 2,232,360 | 2/1941 | Barnett | 175/320 |
| 4,078,620 | 3/1978 | Westlake et al. | 175/48 |
| 4,200,297 | 4/1980 | Tricon | 166/242 |
| 4,291,773 | 9/1981 | Evans | 175/320 |
| 4,388,969 | 6/1983 | Marshall et al. | 166/242 |
| 4,454,913 | 6/1984 | Guidry et al. | 166/324 |
| 4,480,687 | 11/1984 | Terral | 166/321 |

*Primary Examiner*—Stephen J. Novosad
*Assistant Examiner*—Terry Lee Melius

[57] ABSTRACT

An oilfield pressure gauge carrier for use in supporting pressure gauges on a string of pipe in a wellbore including an elongated carrier with a through bore and outer surface recesses for receiving one or more pressure gauges. A pressure gauge is attached to an outer surface for vertical movement in the event of an applied shock force and provided with spring damping devices at either end to absorb shock effects. A restricted flow passageway to the pressure gauge inhibits application of hydraulic surges to the pressure gauge.

8 Claims, 5 Drawing Figures

GAUGE CARRIER

FIELD OF THE INVENTION

This invention relates to a downhole tool carrier for supporting and carrying pressure and temperature measuring gauges into a wellbore, and more particularly, to a gauge or tool carrier which provides a balanced shock mounting support for a sensitive pressure gauge to inhibit damage from occurring from pressure surges to the gauge during running-in of tubing and from pressure surges and shock forces generated by perforating operations while the gauge is in the wellbore.

BACKGROUND OF THE INVENTION

Downhole and temperature measuring gauges have been used for a considerable number of years in downhole well operations to measure temperature and pressure conditions in a wellbore. In one type of pressure measurement the pressure gauge is suspended by a wireline cable in a wellbore which does not typically create adverse conditions for the pressure gauge. However, in typical instances where pressure and temperature measurements are made during a drill stem test, or upon completion of the wellbore by perforation, the gauge is subject to hydraulic pressure surges and downhole shock effects in the pipe string. It is important that the pressure and temperature information or data is accurately obtained for the evaluation of the oil reservoir and productivity of a producing oil sand and thus protection of the pressure gauge against hydraulic surges or shock effects in a pipe string is highly important.

For a drill stem test, the drilling operations are temporarily discontinued when the drilling has reach a desired depth and a drill string containing a packing device, testing valves and a pressure and temperature measuring system are lowered into the open wellbore. The wellbore is packed off or sealed by the packing device, and the pressure below the packer device is measured before opening the testing valves.

Next, the testing valves are opened and during the open period of the valves and after the testing valves are closed, the pressure and temperature of the fluids in a wellbore are measured. Because the formations below the packing device are typically opened to atmosphere or low pressure, downhole pressure surges are quite common.

In a perforating operation, the pressure and temperature guage is typically mounted below a production packer (although occasionally the gauge is disposed above the packer) and lowered into the wellbore where the casing packer is set in the casing. Thereafter, a perforator may be lowered through and below the tubing string to perforate the casing and earth formations below the set packer. Alternatively, the perforator may be attached to the pipe below the packer and run in with the packer. Upon detonation of the perforator, considerable shock forces are generated downhole in the string of pipe supporting the gauge by the explosive nature of the perforator and high pressure surges are developed in the existing fluid below the packer. Thus, the pressure and temperature gauge is subjected to shock forces and surge pressures induced by the perforator. The pressure and temperature guage prior to perforation of the earth formations measure the existing pressure in the wellbore and the subsequent pressure after perforations of the well casing as a function of time.

While running a pressure gauge into a wellbore on a string of tubing the tubing is moved through the fluid in the wellbore. Thus pressure surges are incurred by the pressure gauge by virtue of the running operation of tubing and shock can be encountered if the tubing engages any ledges or shoulders in the borehole.

With the advent of highly sensitive pressure measuring devices utilizing quartz transducers the transducer occasionally can fail or malfunction because of the pressure surge or shock forces in excess of the transducer shock mounting in the pressure guage. This failure can occur typically during running in of a casing into a wellbore, during drill stem testing or upon the firing of a perforator in a wellbore.

Present Invention

The present invention is concerned with providing a pressure gauge carrier which is connectable in a string of pipe to provide a through bore passageway and can mount on its exterior surfaces, one or more pressure and measuring guages. The pressure gauge housing is mounted on a gauge carrier between spring elements which create a balanced force condition and provide a shock absorbing means with a high shock damping effect. This is accomplished by providing a number of reversely stacked belleville or B'ville spring members above and below a pressure gauge housing located on the outside of a gauge carrier on a mounting surface. The gauge housing is frictionally supported on the gauge carrier by clamp means. The force produced by the belleville washers is adjustable by means of an adjusting nut to provide for an equal force balancing or suspension of the gauge housing by force applied to both ends of the gauge housing so that the gauge housing is basically in a neutral position on the gauge carrier with a spring force applied to both ends of the gauge housing to hold the gauge housing in the neutral position. The gauge housing is ported at its lower end to access fluid through a flow passageway between the interior of the bore passageway to the transducer in the gauge housing. The mounting for the gauge carrier is pressure balanced between the exterior of the gauge housing and the interior through bore passageway. The flow passageway has a restricted flow orifice and an expansion chamber between the flow orifice and a transducer in a gauge housing to dampen pressure surges which might otherwise adversely affect the transducer.

BRIEF DESCRIPTION OF THE DRAWINGS

Referring now to the drawings which are a part of this application and which.

DESCRIPTION OF INVENTION

Figure 1:
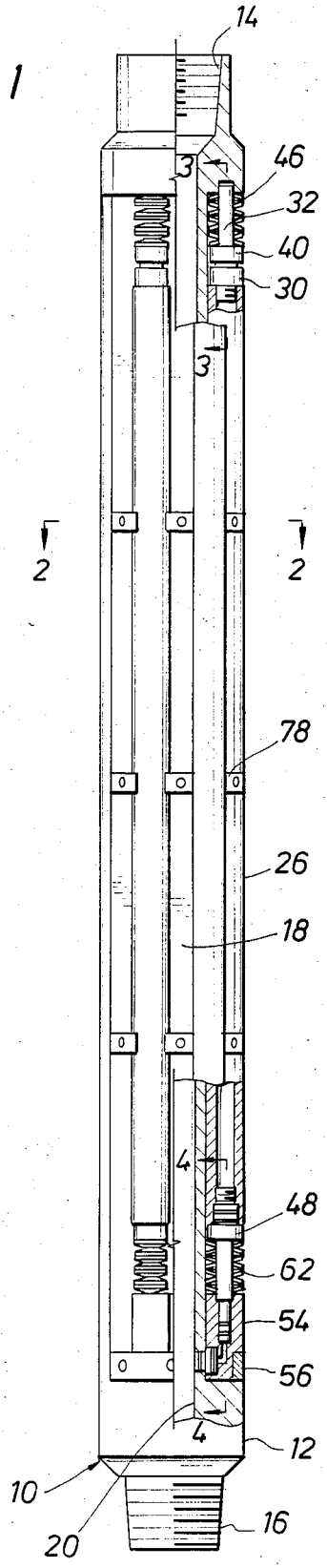
FIG. 1 is a partial view in longitudinal cross section of a gauge carrier in which the present invention is embodied.

Referring now to FIG. 1, a pressure gauge carrier 10 includes an elongated support body member 12 which is provided with an upper, internally threaded connection 14 and a lower, outer threaded connection 16, respectively for interconnection in a string of pipe where the string of pipe and gauge carrier can be disposed in a wellbore traversing earth formations for the taking of pressure and temperature measurements in the wellbore. While not shown, the pressure gauge carrier 10 can be attached above or below a packer means, and above or below a tubing connected perforator means.

The gauge carrier body member 12 is constructed from a tubular drill collar which has a longitudinal and central opening or bore 20 extending through the length of the drill collar where the drill collar has a thick wall in cross section. The outer wall surface of the drill collar is machined or shaped longitudinally of its length to provide three flat surfaces 18 which respectively lie in a plane transverse to a radius line from the drill collar. The flat surfaces 18 are arranged in a triangular configuration about the central axis of the body member 12 and leave lengthwise extending portions 19 of the drill collar intact. The bore 20 is sized as large as possible to permit the passage of tubing and tubing sized tools such as perforator means or other devices. A flat surface 18 terminates at an upper arcuately shaped and downwardly facing end surface 22 and, at a lower, arcuately shaped and upwardly facing end surface 24. The upper and lower end surfaces 22 and 24 are spaced from one another a distance sufficient to accommodate the length of a cylindrically shaped, pressure gauge housing 26.

The pressure and temperature gauge housing 26 contains pressure and temperature sensors and associated electronics (not shown) and is typically cylindrically shaped and is sized to be received in a lengthwise extending groove 27 which extends inwardly from a surface 19. (See FIG. 2) As shown in FIG. 3 the gauge housing 26 typically has an upper internally threaded blind bore 28 which is attachable to a threaded connection on a cable wellhead for transportation through a wellbore. In this instance however, the threaded blind bore 28 is utilized to threadedly receive an elongated upper gauge mounting member 30. The upper gauge mounting member is generally cylindrical in cross-section and provided with suitable wrench flats for facilitating the attachment of the mounting member 30 to the gauge housing 26. The cylindrical upper end 32 of the mounting member 30 is adapted to be slidably received in a blind bore 34 in the upper end surface 22 on the body member 12. The mounting member 30 has a threaded section 36 above a collar section 38 which threadably receives a nut member 40. The nut member 40 is provided with exterior bar openings 42 for receiving a rotating tool to rotate the nut member 40 relative to the mounting member 30. A lock screw 44 is threadedly received in the nut member 40 and can be operated to lock the adjusting nut member 40 relative to mounting member 30 once a desired positional relationship of the nut member 40 relative to the mounting member 30 is obtained. Between the nut member of 40 and the upper arcuate end surface 22 are a number B'ville spring washers 46 constructed of spring material. The B'ville spring washers 46 are well known devices and typically consist of a conically shaped rings constructed from spring material such that the washer will flex or bend when loads are applied. The B'ville spring washers 46 are arranged in opposite facing directions and have central openings for being received on the mounting member 30 between the adjusting nut member 40 and the upper end surface 22. The B'ville spring washers 46 fill the space between the adjusting nut member 40 in its lower position and the upper arcuate end surface 22.

Figure 4:
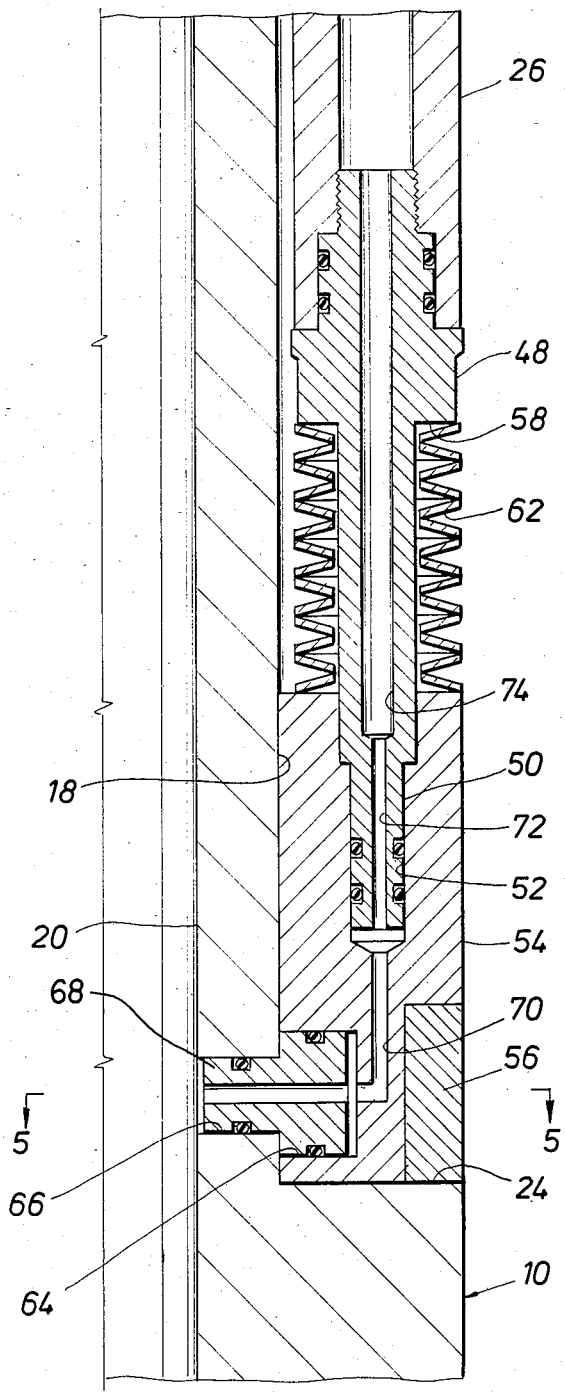
FIG. 4 is a view in partial cross section of a mounting for a gauge carrier housing at the lower end of a gauge carrier taken along line 4—4 of FIG. 1.

The pressure gauge housing 26 at its lower end (See FIG. 4) has an internally threaded end for threadedly receiving a tubular lower mounting member 48 which is part of a passageway means to conduct fluid under pressure from the central bore to the pressure gauge housing 26 and to access the fluid to a pressure sensing transducer within the pressure gauge housing 26. In this instance, the pressure gauge housing 26 threadedly and sealingly receives the upper end of the tubular lower mounting member 48 and the lower mounting member 48 has a lower end 50 which is slidably and sealingly received within a polished bore 52 in a housing adapter 54. The housing adapter 54 is attached to the body member 12 by means of an arcuately shaped clamp member 56. Between a downwardly facing shoulder 58 on the lower mounting member 48 and an upper facing surface 60 on housing adapter 54 are a number of B'ville washer members 62 which are arranged in oppositely facing directions. The washer members 62 have openings for sliding reception over the lower mounting member 58.

The housing adapter 54 is provided with a transverse bore 64 which is concentrically aligned with a transverse access bore 66 in the wall of the body member so that an insert member 68 with O-ring seals can be inserted into the bore 66 in the body member 12 and into the bore 64 of the housing adapter 54. The insert member 68, the housing adapter 54 and mounting member 48 define a flow passageway means 70 to the interior of a pressure gauge housing containing a pressure transducer.

A feature of the present invention is embodied in the flow passageway 70 in providing a smaller diameter bore section 72 and a larger diameter bore section 74 where the larger bore section 74 is between the bore section 72 and a pressure transducer in the gauge housing 26. A hydraulic pressure surge in the well fluid caused by detonation of a perforator has a short time duration and high intensity. The bore section 72 restricts the flow of fluid under the effect of the pressure surge and the bore section 74 permits expansion of the fluid so that the pressure surge effect is damped and isolated before reaching the pressure transducer.

Figure 2:
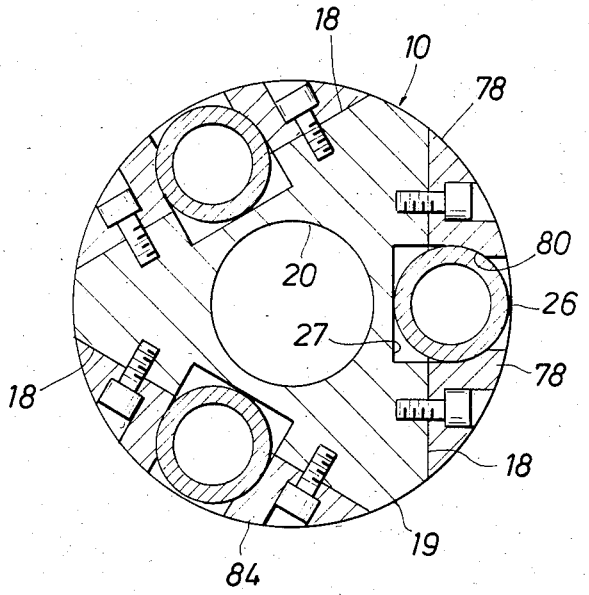
FIG. 2 is a view in cross section taken along line 2—2 of FIG. 1, but enlarged for illustration.
Figure 3:
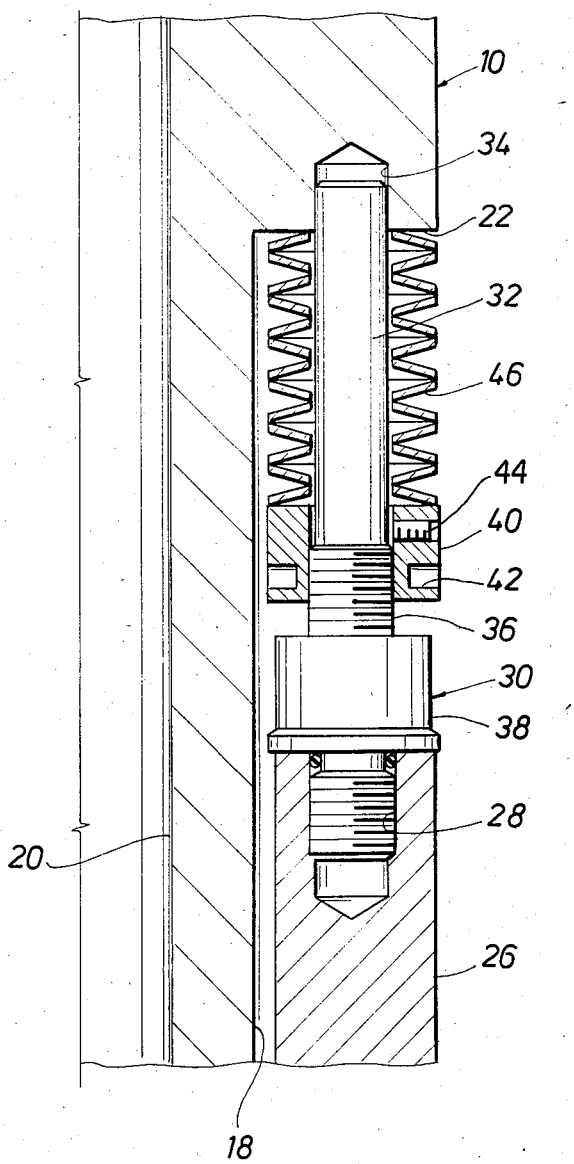
FIG. 3 is a partial view in cross section of the upper mounting arrangement for a pressure gauge housing on a gauge carrier taken along line 3—3 of FIG. 1.

As shown in FIG. 1 and FIG. 2, the clamp member 56 for the housing adapter 54 is arcuately shaped and notched at its center so as to fit over a recess in the housing adapter 54. Openings 76 in the clamp member 56 are aligned with the threaded openings in the body member 12 so that cap screws may be used to attach the clamp member 56 and housing adapter 54 to the body member 12.

At various locations along the length of the gauge housing 26, clamp members 78 are provided to frictionally affix the gauge housing 26 to the body member 12. The clamp members 78 are provided with an interior curved surface to conform to the outer surface of the gauge housing 26 and have openings 82 to align with threaded openings in the body member 12 for attachment by cap screws or the like. The interior surfaces 80 of the clamp members 78 are sized relative to the body member 12 and the gauge housing 26 so that upon an application of a torque wrench, the housing 26 is rigidly but frictionally attached to the body member 12 by the cap screws with a selected frictional force. The clamping force provides for frictional attachment of the gauge housing 26 to the body member 12 so that if vertical shock forces are applied to the body member 12 the gauge housing 26 will shift under high gravitational forces with the degree of shifting being controlled by the force of the B'ville washers. The outer surfaces 84 of the clamp members 78 is curved to match the outer curvature of the body member 12.

In assembly, the pressure gauge housing 26 is attached to the body member or gauge carrier 12 by the upper mounting member 32 to the top end of the gauge housing 26 and positioning the B'ville washers 46 over the mounting member and on top of the adjusting nut 40. Next, the lower mounting member 48 is attached to the gauge housing 26 and B'ville washers are inserted between the gauge housing 26 and the housing adapter 54. The upper end of the tubular mounting member 32 is inserted into the blind bore 34 and the lower end of the housing adapter 54 is positioned so that the seal insert member 68 is located in the bore 64 of the housing adapter and the bore 66 in the body member. The clamping flange 56 for the housing adapter 54 is attached, to the body member and the clamp members 78 along the length of the gauge housing 26 are tightened to provide selected frictional force values.

Figure 5:
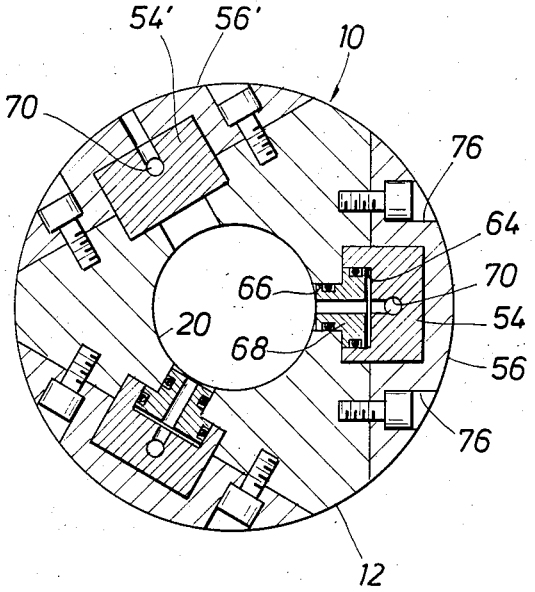
FIG. 5 is a view in cross section taken along line 5—5 of FIG. 4 but enlarged for illustration and showing the entire cross section across the gauge carrier and gauge housings.

While the opening of each of the housing adapter 54 is shown to the interior of the body member 12, as shown in FIG. 5, one of the housing adapters 54[1] can be ported through a clamp member 56[1] to the exterior of the clamp member 56[1], if desired, to sample pressure on the outside of the pipe. To do this, a different housing adapter 56[1] is employed where a passageway is opened to the outside facing surface of the housing adapter 56[1] rather than the inside facing surface of the housing adapter.

The gauge carrier 10 is coupled in a string of pipe or below a packer and lowered into a wellbore for its intended operation. If perforating means are employed in the operation, upon detonation of the perforator means the pressure surge produced by the perforator means in the fluid is balanced across the lower end 50 and is filtered by the restricted opening 72 so that there is a minimum effect upon the pressure transducer within the pressure housing 26 thus the device provides for a protection of the pressure sensing element.

Upon detonation, a perforating means also develops a vertical shock force effect on the suspending pipe in the wellbore. The suspension of the gauge by the B'ville washers at each end under spring force provides a shock mounting to isolate the gauge housing from vertical shock forces induced in the body member. The frictional force between the clamps 78 and the gauge housing 26 permit shifting the housing 26 under acceleration forces and dampening by virtue of the spring members 46 and 62.

It will be apparent to those skilled in the art that various changes may be made in the invention without departing from the spirit and scope thereof and therefore the invention is not limited by that which is enclosed in the drawings and specifications but only as indicated in the appended claims.

We claim:

1. An oil field pressure gauge carrier for use, with a string of pipe having a central bore, in a well bore which traverses earth formations and contains a liquid, an elongated gauge carrier body member adapted for coupling in a string of pipe, said body member having a central bore arranged for alignment with respect to a bore of a string of pipe, said carrier body member having an outer wall and at least one lengthwise extending recess in said outer wall, said recess having sufficient depth to accommodate an elongated pressure gauge housing within said recess;

at least one pressure gauge having a pressure sensing transducer in a pressure gauge housing, said gauge housing having an access port opening to said sensing transducer, means on said carrier body member for securing a pressure gauge housing in said recess;

flow passageway means in said body member for placing liquid in a well bore in fluid communication with said access port, said passageway means further having a restricted flow orifice, and having a liquid expansion chamber disposed between said flow orifice and said access port of the pressure gauge housing for damping hydraulic pressure surges developed in a well bore before such hydraulic pressure surges reach said access port.

2. An oilfield pressure gauge carrier for use, with a string of pipe having a central bore in a well bore which traverses earth formations and contains a liquid, and where the gauge carrier and a pressure gauge can be subjected to vertical shock forces in a well bore, at least one pressure gauge having a pressure sensing transducer in a pressure gauge housing, an elongated carrier body member adapted for coupling in a string of pipe, said body member having a central bore arranged for alignment with respect to a bore of a string of pipe, said carrier body member having an outer wall with at least one lengthwise extending recess in said outer wall, said recess having sufficient depth to accommodate an elongated pressure gauge housing within the recess;

means for securing said pressure gauge housing in said recess and for permitting movement of said pressure gauge housing in said recess relative to the lengthwise direction of the said recess;

spring means in said recess for applying a spring force to each end of said pressure gauge housing in said recess; and independent force adjustment means in said recess cooperable with spring means for adjusting the force on said spring means to obtaining a desired spring force on the ends of said pressure gauge housing.

3. The apparatus as defined in claim 2 wherein said spring means comprises B'ville spring washers.

4. As an oilfield pressure gauge carrier for use, with a string of pipe having a central bore, in a well bore which traverses earth formations and contains a liquid and where the gauge carrier can be subjected to vertical shock forces in a well bore, at least one pressure gauge having a pressure sensing transducer in a pressure gauge housing, an elongated tubular gauge carrier body member having a thick wall where the bore of the body member is arranged for alignment with the bore of a string of pipe, at least one lengthwise extending recess extending inwardly from the outer surface of the wall of said body member for receiving a pressure gauge, said recess defining an upper, downwardly facing end surface and a lower, upwardly facing end surface, said upper end surface having an upper vertical bore, pin means for coupling to an upper end of a gauge housing and for sliding reception in said upper vertical bore, first upper spring means disposed on said pin means between said upper end surface and the upper end of a gauge housing, attachment means at said lower end surface for defining a lower vertical bore, tubular pin means for coupling to a lower end of a gauge housing and for sliding and sealing reception in said lower vertical bore, second lower spring means disposed on said tubular pin means between said attachment means and the lower end of a gauge housing, adjustment means between one of said spring means and an end surface for adjusting the compression of said spring means relative to a gauge housing, and port means for placing said tubular pin means in fluid communication with fluid in a well bore.

5. The apparatus as defined in claim 4 wherein said port means opens to the bore of said tubular body member.

6. The apparatus as defined in claim 4 wherein said port means opens to the exterior of said tubular body member.

7. The apparatus as defined in claim 4 and further including frictional clamping means along said body member for frictionally securing a gauge housing to the body member.

8. The apparatus as defined in claim 4 wherein the tubular pin means has a smaller bore section intermediate of said port means and a larger bore section leading to the gauge housing.

* * * * *